US007221273B1

(12) United States Patent
Seyfarth

(10) Patent No.: US 7,221,273 B1
(45) Date of Patent: May 22, 2007

(54) AUTOMATED LOCKING SYSTEM

(76) Inventor: Timothy J. Seyfarth, 3670 E. Chipman Rd., Phoenix, AZ (US) 85040

( * ) Notice: Subject to any disclaimer, the term of this patent is extended or adjusted under 35 U.S.C. 154(b) by 247 days.

(21) Appl. No.: 11/082,152

(22) Filed: Mar. 16, 2005

(51) Int. Cl.
*G08B 13/08* (2006.01)

(52) U.S. Cl. ..... 340/545.1; 340/5.7; 70/99

(58) Field of Classification Search ..... 340/545.1, 340/5.2, 5.7, 506, 691.6, 574; 70/99, 266, 70/278.1
See application file for complete search history.

(56) References Cited

U.S. PATENT DOCUMENTS 4,083,424 A 4/1978 von den Stemmen et al.
4,254,582 A 3/1981 McGee
4,526,301 A 7/1985 King et al.
4,593,491 A * 6/1986 Carlson et al. ..... 49/13
4,648,638 A 3/1987 McKnight
4,819,379 A 4/1989 Kenzelmann et al.
4,970,508 A * 11/1990 Webster, III ..... 340/14.1
5,231,272 A * 7/1993 Mardon ..... 235/382
5,532,521 A 7/1996 Leininger
5,720,333 A 2/1998 Turvey
5,871,038 A 2/1999 Gompertz et al.
5,936,544 A * 8/1999 Gonzales et al. ..... 340/5.22
5,946,660 A 8/1999 McCarty et al.
6,027,148 A 2/2000 Shoemaker
6,049,448 A 4/2000 Lanigan et al.
6,310,549 B1 * 10/2001 Loftin et al. ..... 340/547
6,439,009 B1 * 8/2002 Heese et al. ..... 70/92
6,655,180 B2 * 12/2003 Gokcebay et al. ..... 70/432
6,967,562 B2 * 11/2005 Menard et al. ..... 340/5.64
2003/0029266 A1 2/2003 Gillingham et al.

FOREIGN PATENT DOCUMENTS

JP 2002322848 11/2002

* cited by examiner

*Primary Examiner*—Phung T. Nguyen
(74) *Attorney, Agent, or Firm*—Frank J. McGue

(57) ABSTRACT

An improved storage system includes a plurality of individual storage units enclosed in a secured perimeter with security gates for entry and exit. Each individual storage unit has a door, an alarm and a locking mechanism. Each door has a sensor which senses whether that door is open or closed. Each locking mechanism has a sensor which senses whether that locking mechanism is locked or unlocked. The sensors are in electrical communication with a computer. Each locking mechanism has a motor for moving between locked and unlocked, the motor controlled by the computer. Access control units are located near the security gates in electrical communication with the computer. The computer device reviews information from the access control unit and opens and closes the security gate, locks and unlocks the locking mechanisms, turns on and off the alarms, and determines the open and closed status of each door in response to the information.

15 Claims, 13 Drawing Sheets

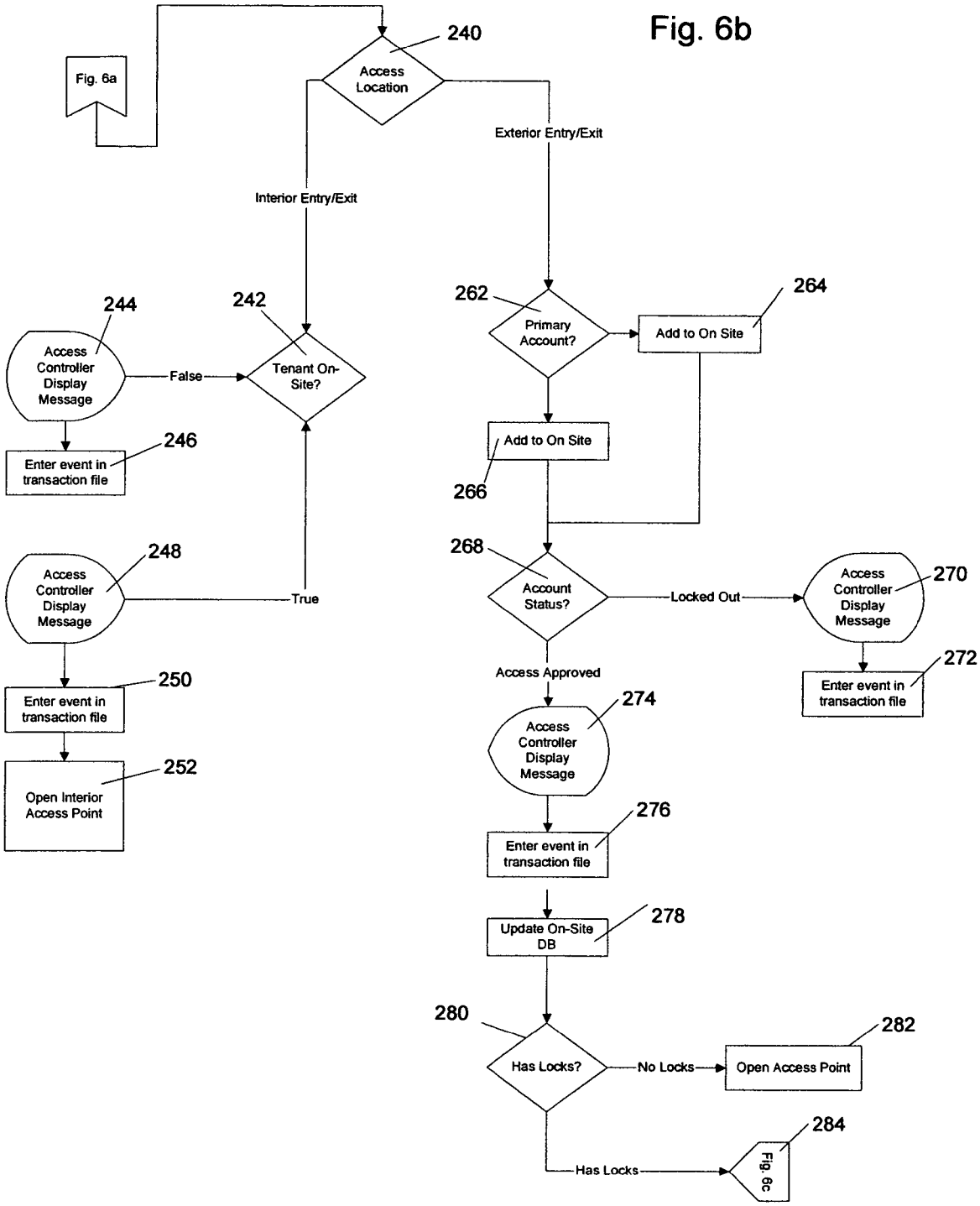
Fig. 6b
Fig. 6a
240
Access Location
Exterior Entry/Exit
Interior Entry/Exit
244
242
Access Controller Display Message
False
Tenant On-Site?
246
Enter event in transaction file
248
Access Controller Display Message
True
250
Enter event in transaction file
252
Open Interior Access Point
262
Primary Account?
264
Add to On Site
Add to On Site
266
268
Account Status?
Locked Out
Access Controller Display Message
270
Enter event in transaction file
272
Access Approved
274
Access Controller Display Message
276
Enter event in transaction file
Update On-Site DB
278
280
Has Locks?
No Locks
Open Access Point
282
Has Locks
Fig. 6c
284

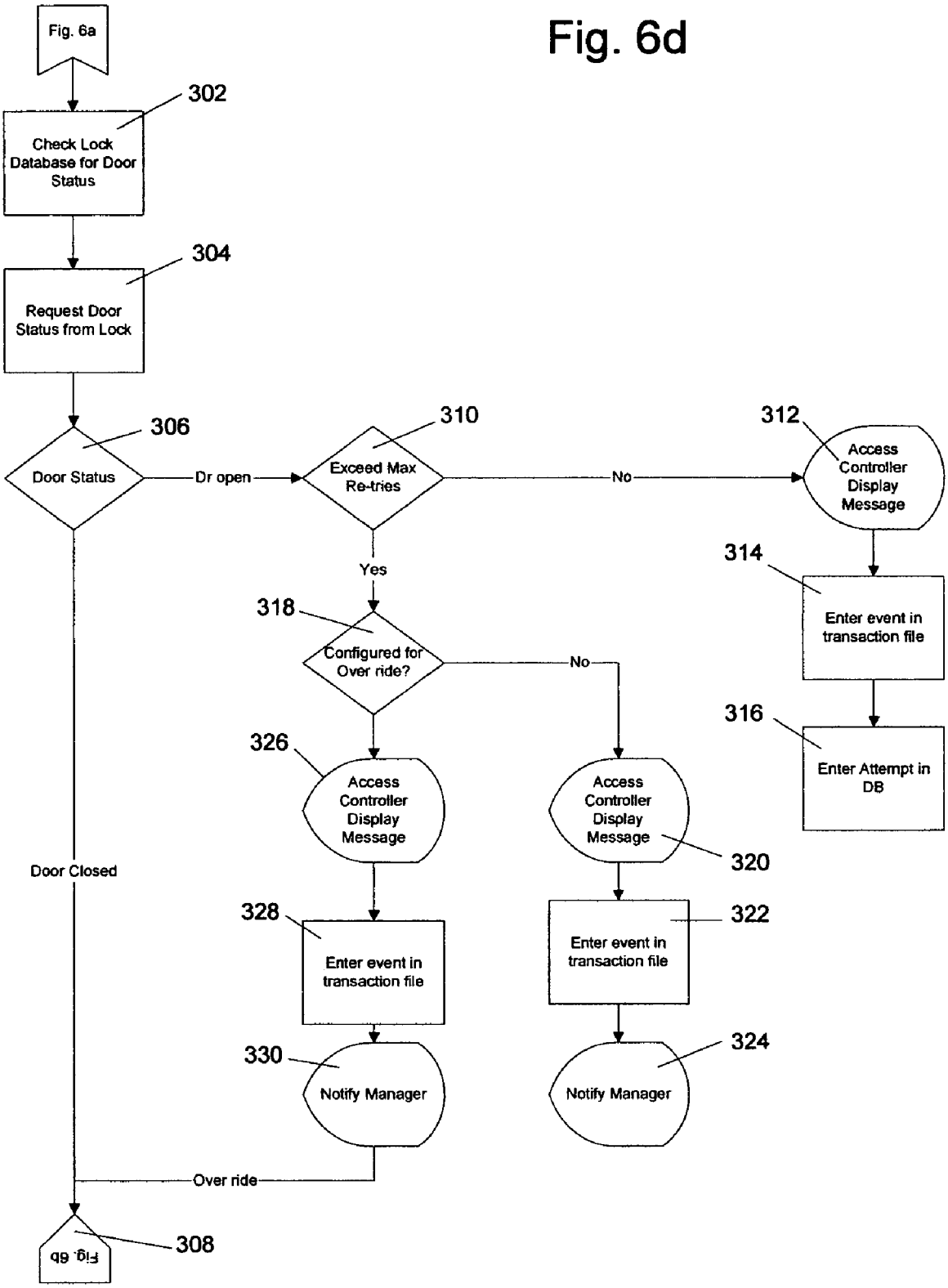
Fig. 6d
Fig. 6a
302
Check Lock Database for Door Status
304
Request Door Status from Lock
306
Door Status
Dr open
310
Exceed Max Re-tries
No
312
Access Controller Display Message
314
Enter event in transaction file
316
Enter Attempt in DB
Yes
318
Configured for Over ride?
No
326
Access Controller Display Message
Access Controller Display Message
320
Door Closed
328
Enter event in transaction file
322
Enter event in transaction file
330
Notify Manager
324
Notify Manager
Over ride
Fig. 6b
308

AUTOMATED LOCKING SYSTEM

TECHNICAL FIELD

This invention relates generally to the field of locking systems including self storage facilities in which customers rent individual storage units, and, more particularly, to a self storage facility having either a resident manager or one that operates virtually unattended.

BACKGROUND OF THE INVENTION

Self-storage facilities are well known in the art and generally comprise a plurality of individual storage units disposed within a secured perimeter for the purpose of safeguarding/storing articles. In a typical arrangement, each storage unit includes a storage compartment disposed within a garage or shed-like structure for receiving goods/articles therewithin, a door member for accessing the interior of the storage compartment, and a locking mechanism for fastening the door member in a closed position to securely maintain the contents of the storage compartment when unattended. As is required, the customer will provide, or the facility will sell or give each customer their own lock with associated key for securing the locking mechanism.

The secured perimeter typically includes a fence or barrier surrounding the storage facility having at least one access point such as an automated gate for exiting and entering, wherein gate access is restricted to only those individuals having proper clearance or authorization to enter the storage facility so as to deter theft and/or vandalism. The storage units are usually offered for rent for various periods of time such that a person in need of short or long term storage may simply lease one or more storage units until such time that they are able to transfer or otherwise dispose of the stored goods.

Self storage facilities are old in the art. U.S. Pat. No. 6,049,448 entitled "Security System for Roll Down Doors" which issued on Apr. 11, 2000 to Lanigan et al. shows a roll down door solenoid lock suitable for use in such facilities.

U.S. Pat. No. 5,720,333 entitled "Locking Assembly" which issued on Feb. 24, 1998 to Turvey discloses a lock for a rolling gate using a solenoid.

U.S. Pat. No. 5,936,544 entitled "Wireless Access System" which issued on Aug. 10, 1999 to Gonzales et al. provides wireless access through multiple doors.

U.S. Pat. No. 5,871,038 entitled "Remote Controlled Mechanical Chain Barrier" which issued on Feb. 16, 1999 to Gompertz et al. shows a remote controlled gate with a solenoid lock.

U.S. Pat. No. 5,946,660 entitled "Automated Storage System" which issued on Aug. 31, 1999 to McCarty et al. shows a self storage facility having kiosks available for users to undertake self storage transactions without the need for an attendant.

While the self-storage facilities of the prior art do accomplish the goal of providing temporary storage space to people in need thereof, there are several significant disadvantages which precipitate the need for the present invention.

First, if a customer falls behind in payments, that customer often is able to access their individual storage until an attendant or accounting software changes the access rights to the gate for that particular customer. However, even after the access code is deleted, the customer can often still obtain access to the facility via a friend or simply "tailgating" a legitimate user with a valid code through the gate. Once inside, the delinquent customer will have access to the individual unit, particularly if he or she provided their own lock and the facility attendant has not put an additional lock on the unit manually, in the parlance of the profession, adding an overlock to the individual unit.

Thus, there is a need in the self storage industry for a system which allows a remote facility to allow or disallow access to a particular storage unit without the need for an on site attendant as well as additional protection for attended facilities. Such an automatic overlock system would facilitate payments, and may be combined with a kiosk which allows a tenant to lease or pay rent at any time thereby reducing the number of man hours needed for staffing and allowing managerial personnel to focus on increasing business rather than servicing existing or new clients.

The present invention meets these needs.

SUMMARY OF THE INVENTION

It is an object of this invention to provide a system which allows or disallows access to a particular storage unit without the need for an on site attendant.

It is an further object of this invention to provide an improved system which provides security and safety for a storage facility without requiring an attendant.

It is still another object of this invention to provide a system which allows initial leasing of a storage unit without the need for an attendant.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIGS. 6*a*, 6*b*, 6*c*, 6*d* are, in combination, a flow chart showing the system used when attempting access to, from or within a storage facility;

DESCRIPTION OF THE PREFERRED EMBODIMENT

Figure 1:
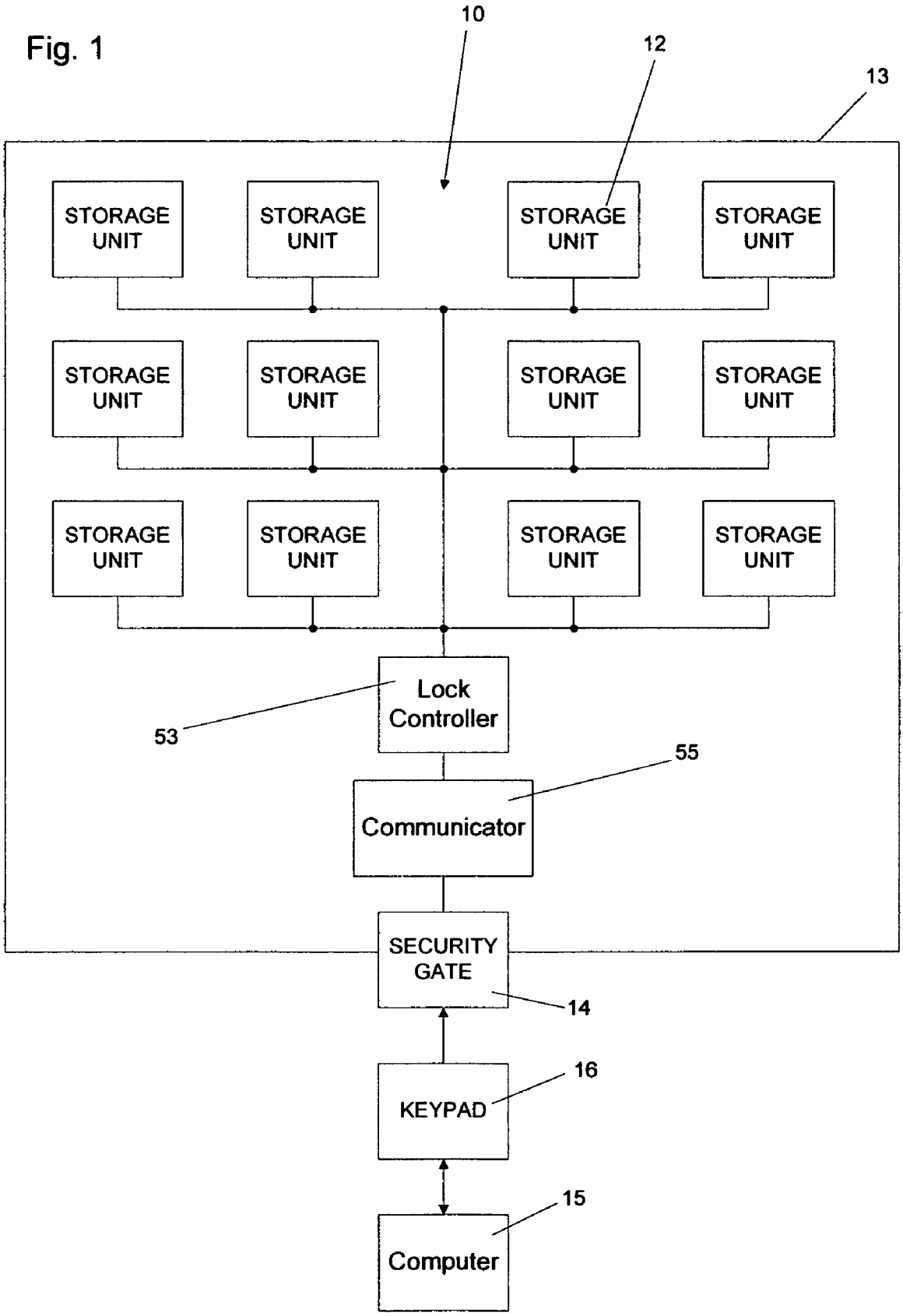
FIG. 1 is a schematic showing the basic elements of the present invention.

Referring more particularly to the drawings by characters of reference, FIGS. 1–9 disclose combinations of features which constitute the components of a storage facility system 10 of the present invention. In the presently preferred embodiment, system 10 comprises a plurality of individual storage units 12 located behind a secured perimeter 13 having a security gate 14 controlling access thereto. At security gate 14, an access control unit 16 is located which, as described in detail below, allows a user to access their individual storage unit 12 via a computer 15.

Those skilled in the art will recognize that other systems are certainly contemplated within the scope of the present invention. For example, the use of a secured perimeter 13 with security gate 14 is optional as, in some facilities, the perimeter is not secure and no gate 14 is employed. The user simply approaches a free standing access control unit 16 without the gate 14 or secured perimeter 13.

Figure 2:
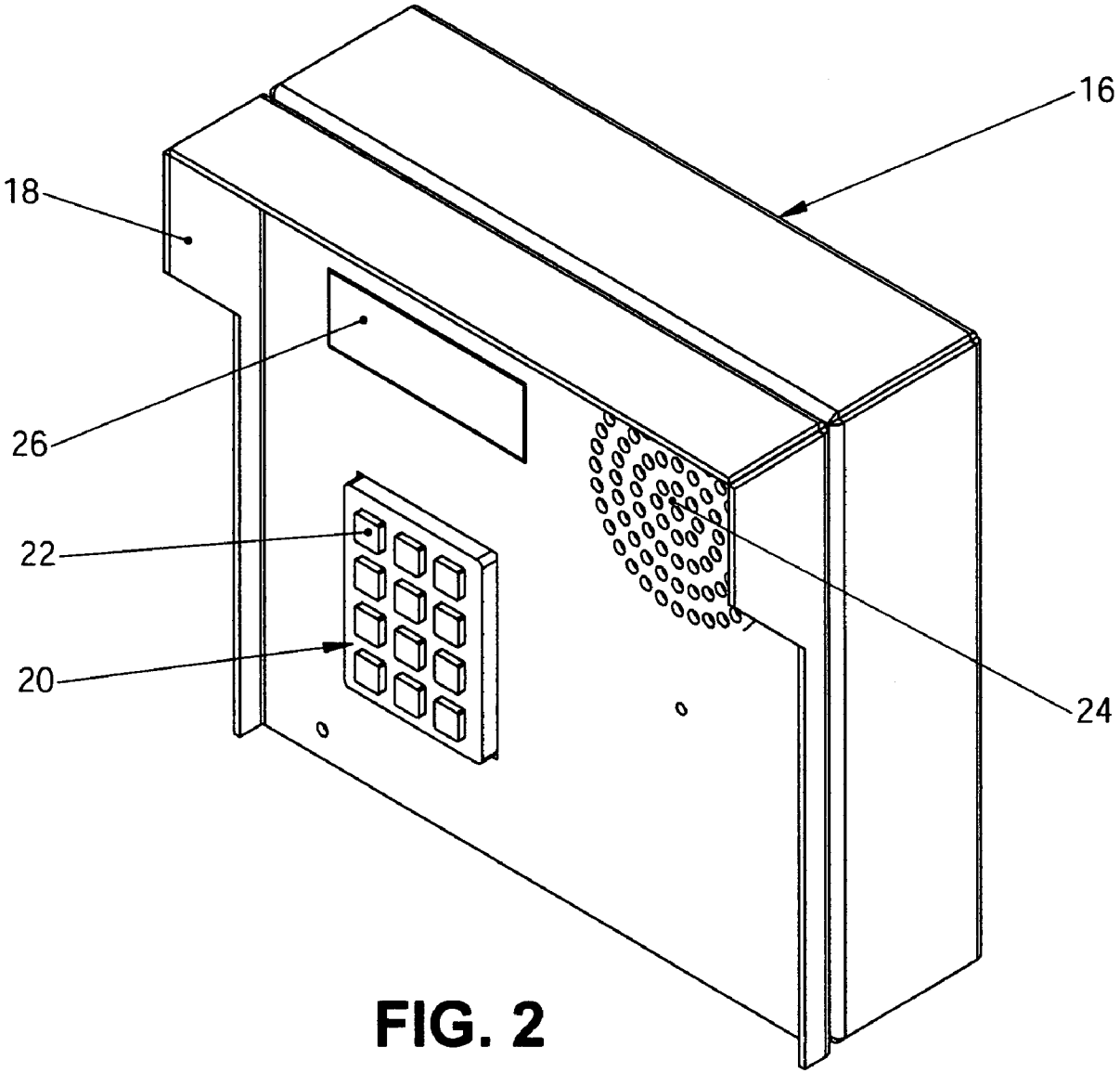
FIG. 2 is a perspective view of a access control unit used in the present invention.

As best seen in FIG. 2, one embodiment of access control unit 16 comprises a housing 18 having a numeric access control unit 20 comprising a plurality of keys 22 mounted on the front thereof. In the preferred embodiment, there are 12 keys 22 having numerals 0–9 and an asterisk (*) and pound (#) sign thereon. Those skilled in the art will recognize that the particular layout of access control unit 16 depicted herein is for exemplary purposes only, and that the invention is not limited to this particular embodiment. Other access methods such as card swipes or finger prints are certainly within the scope of this invention.

A speaker 24 is preferably provided for communication with an attendant if needed. Note that the attendant does not have to be on site; in fact, the attendant can be located anywhere in the world. A camera can also be used to facilitate face to face communication if desired. Lastly, a display 26 is provided to facilitate communication between the user and computer 15, again located anywhere in the world.

Figure 3:
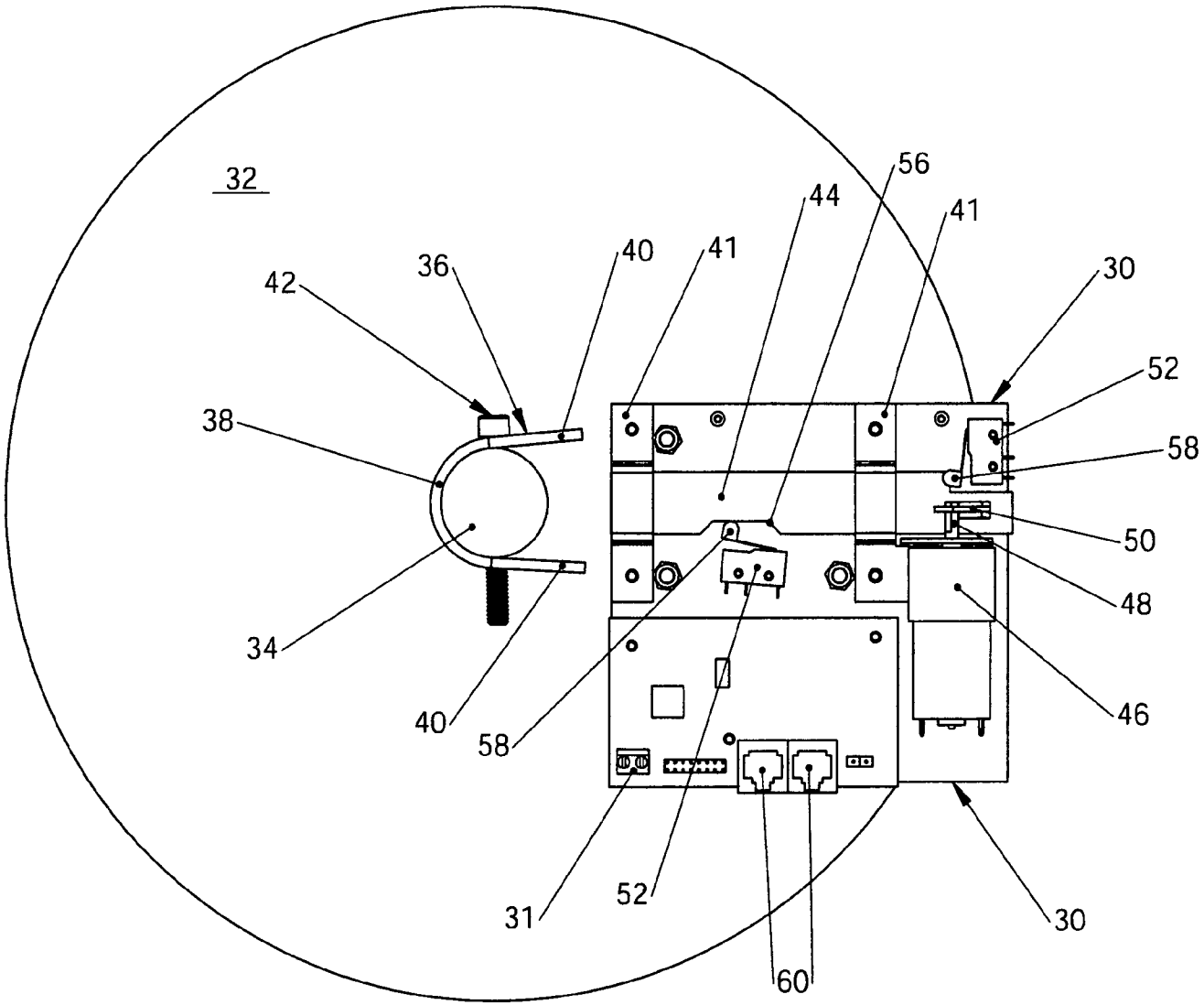
FIG. 3 is a side view of a lock in an unlocked position used in the present invention.
Figure 4:
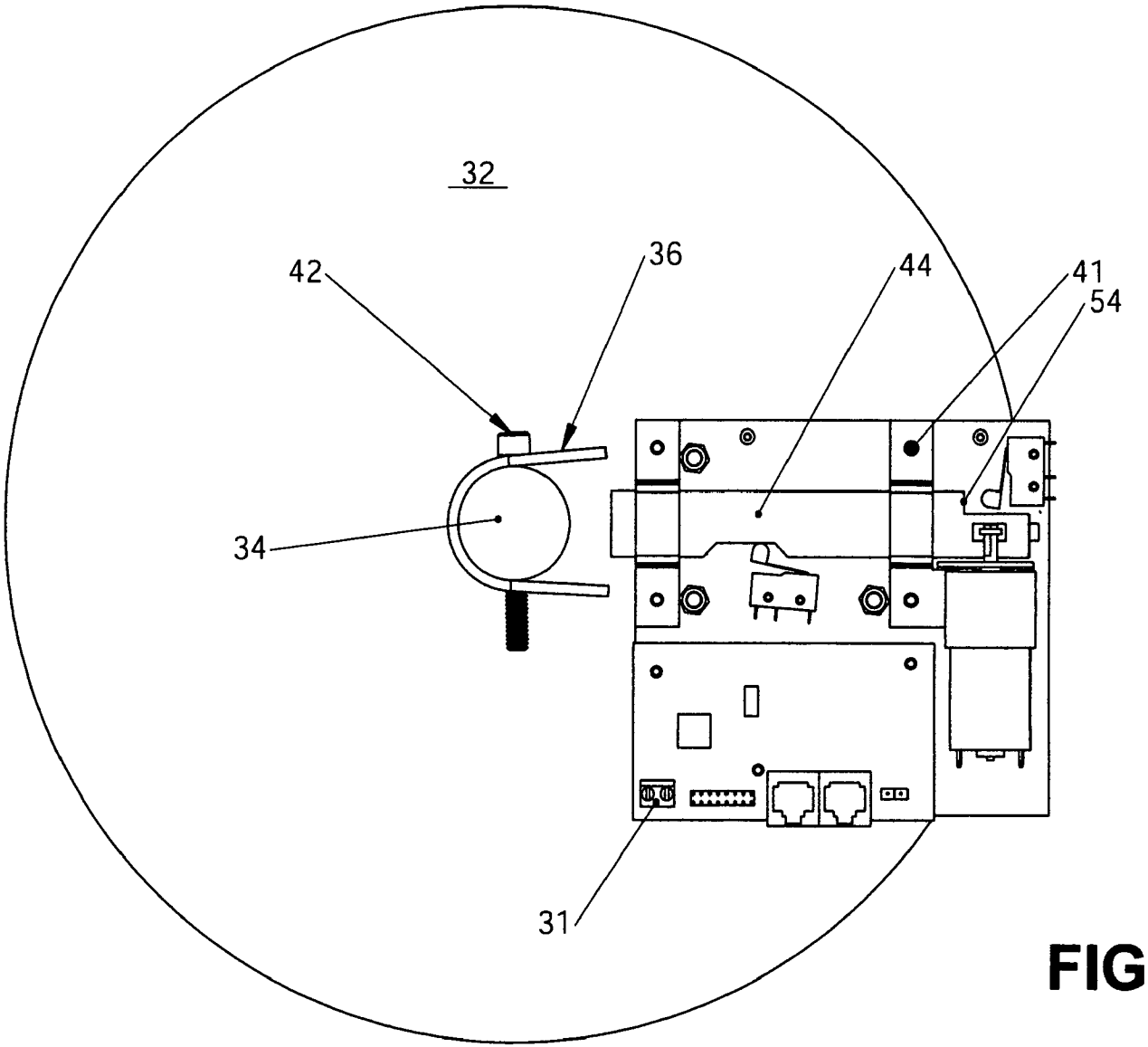
FIG. 4 is a side view of the lock of FIG. 3 in an intermediate position used in the present invention.
Figure 5:
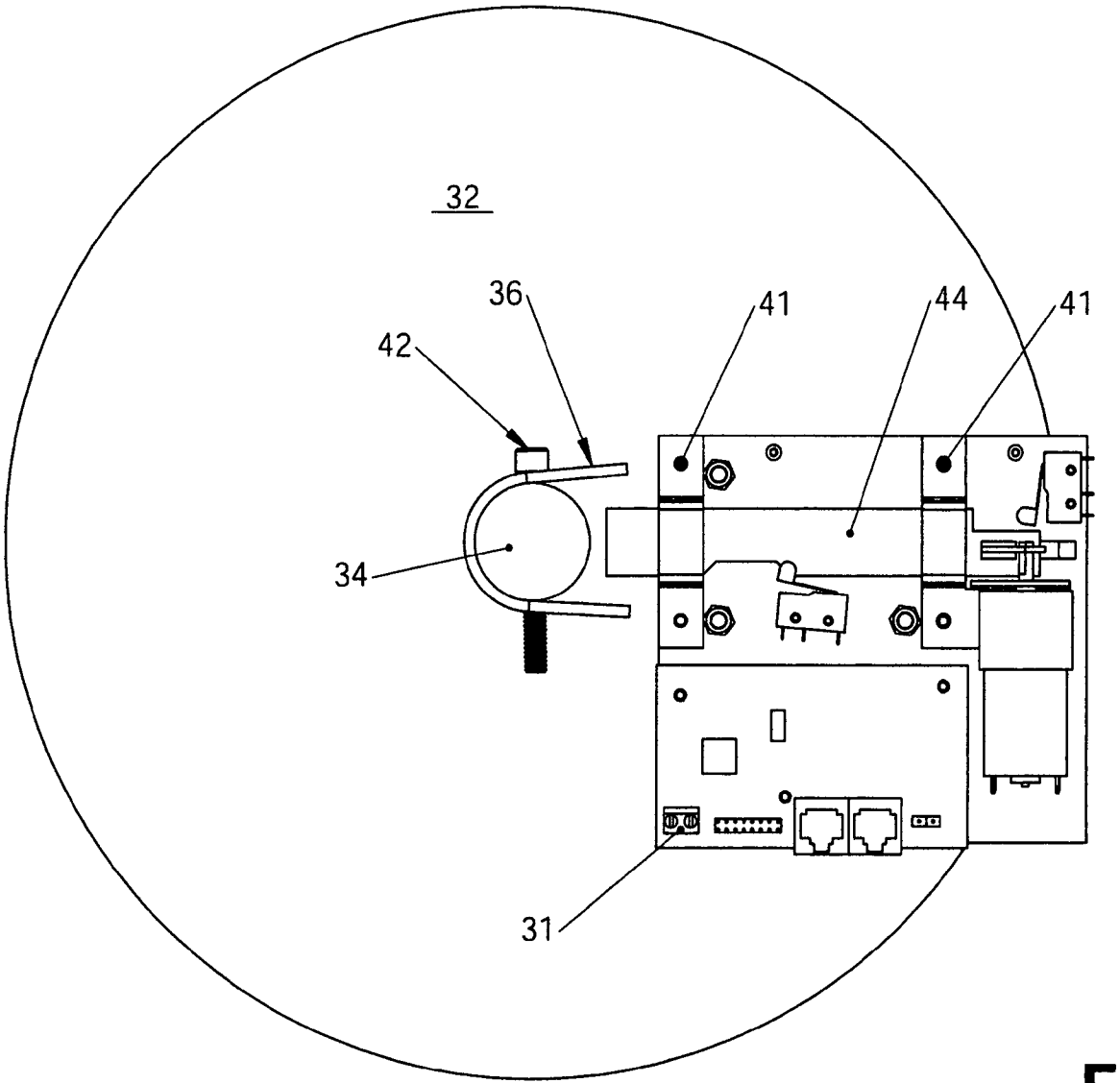
FIG. 5 is a side view of the lock of FIG. 3 in a locked position used in the present invention.

FIGS. 3–5 depict a locking mechanism 30 suitable for use with the present invention. Locking mechanism 30 is used in combination with a roll up door 32 which rotates about an axle 34 to open and close as is well known in the art. A U-shaped locking member 36 has a base 38 around axle 34 and two legs 40 extending away from axle 34. A pin 42 extends through said locking member 36 and axle 34 to secure said elements to each other.

A lock bar 44 is mounted by two brackets 41 to slide between a locked position between legs 40 as depicted in FIG. 5 and an unlocked position outside of legs 40 as depicted in FIG. 3. An intermediate position in which lock bar 44 is proximate to the ends of legs 40 is depicted in FIG. 4. In the locked position, lock bar 44 prevents legs 40, and hence locking member 36 and axle 34 from rotating thereby preventing door 32 from moving. In the unlocked position, lock bar 44 does not interfere with movement of legs 40, and hence locking member 36 and axle 34 can rotate freely to open door 32.

The movement of lock bar 44 is controlled by a motor 46 having a drive shaft 48 extending upwardly therefrom to engage a drive arm 50 which is affixed to lock bar 44. The rotation of drive shaft 48 moves drive arm 50, and hence lock bar 44, between the respective positions as shown in FIGS. 3–5.

To determine the particular position of lock bar 44 at any given time, two position sensors 52 work in conjunction with a pair of shoulders 54 and 56 formed on lock bar 44. As illustrated, position sensors 52 are simple limit switches which detect when arms 58 extending therefrom engage shoulders 54 and 56. As shown, one position sensor 52 is positioned to engage shoulder 54 when lock bar 44 is in an unlocked position as shown in FIG. 3. The other position sensor 52 is positioned to engage shoulder 56 when lock bar 44 is in a locked position as shown in FIG. 5. When neither position sensor 52 is engaged, lock bar 44 is in the intermediate position as shown in FIG. 4.

Position sensors 52, motor 46 and locking mechanism 30 are all in electrical communication via jacks 60 with lock controller 53 and communicator 55 to computer 15 as shown in FIG. 1. Further, locking mechanism 30 connects to alarms 31.

Figure 8:
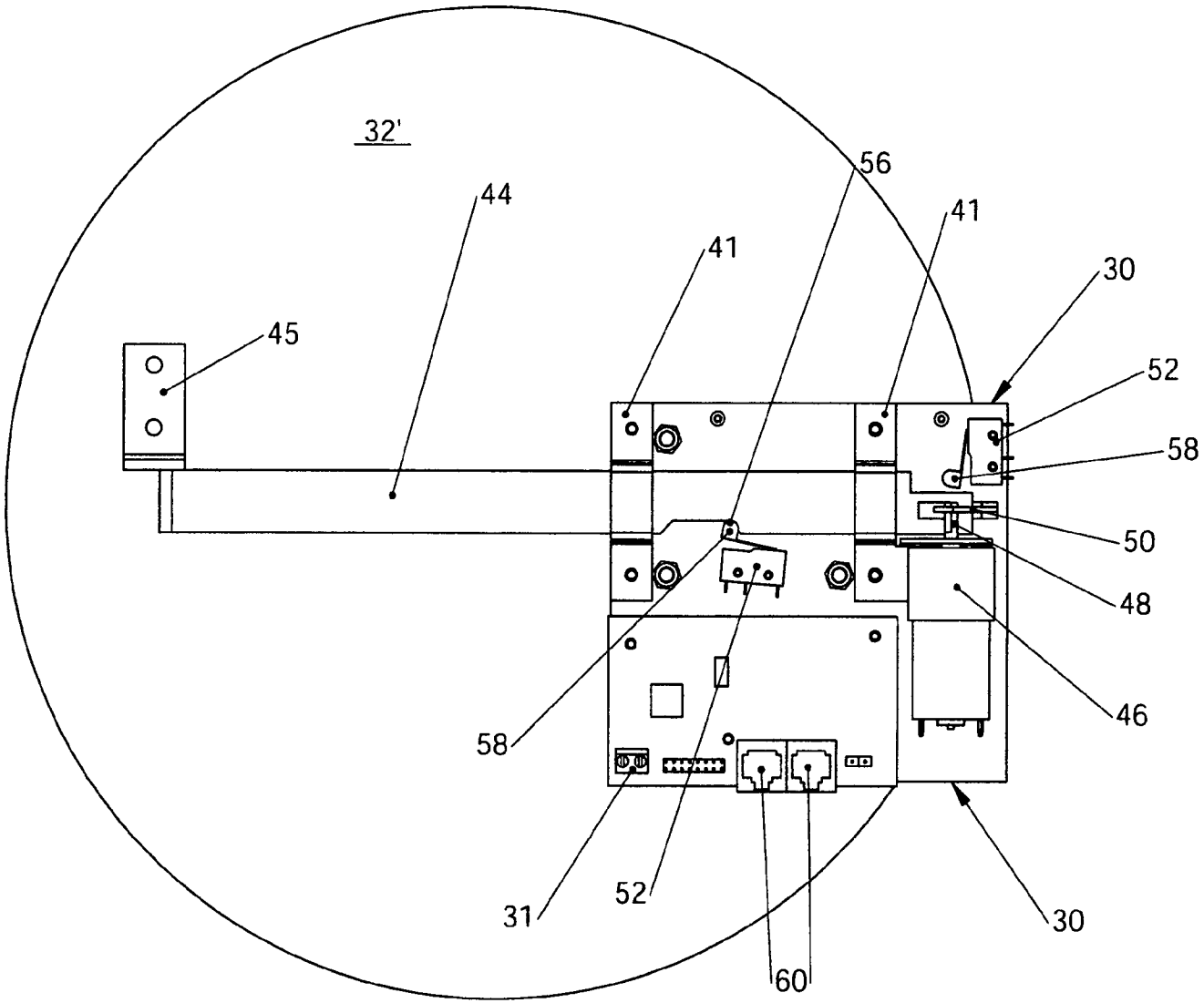
FIG. 8 shows an alternate lock in a locked position.
Figure 9:
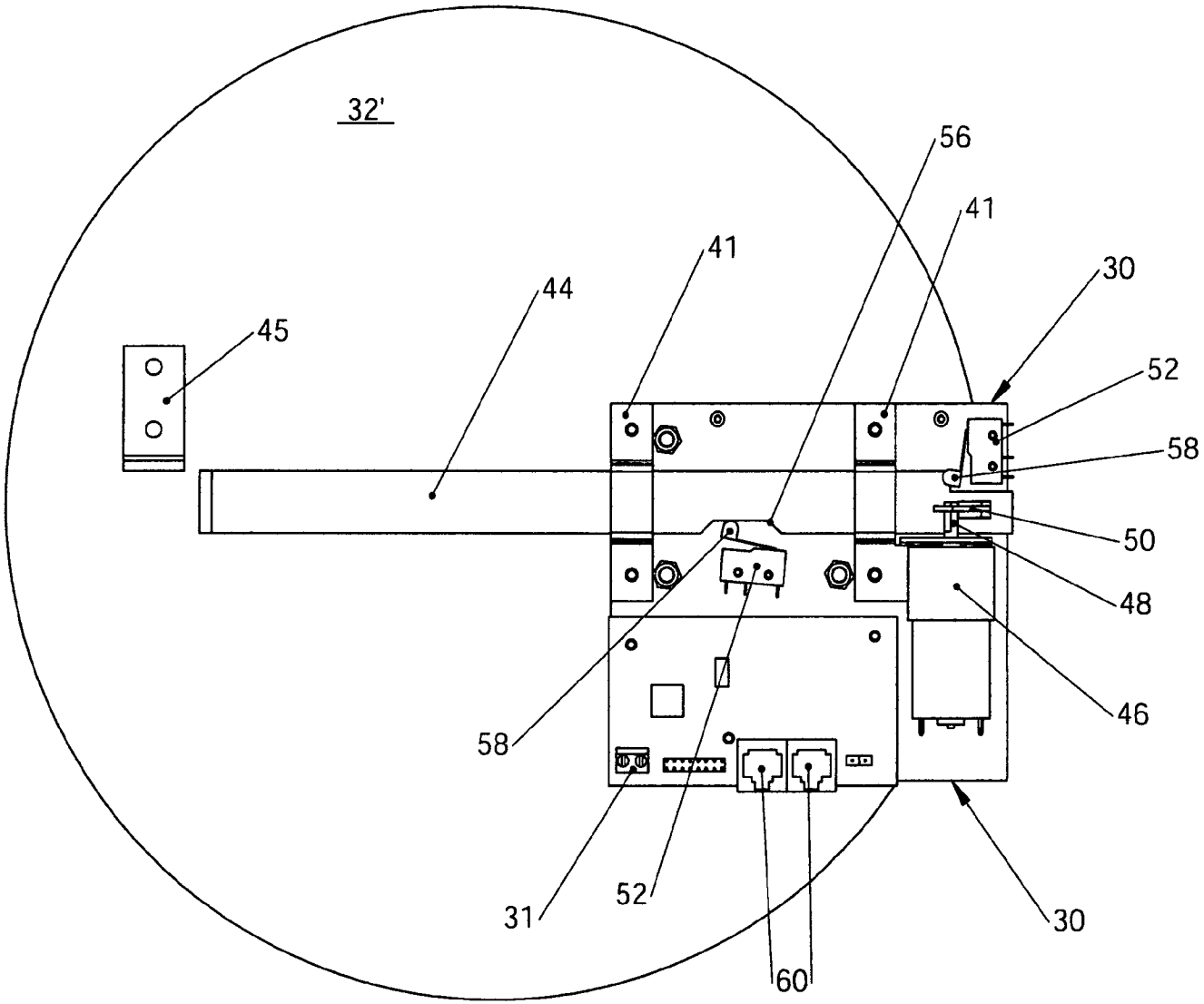
FIG. 9 shows the alternate lock of FIG. 8 in an unlocked position.

Those skilled in the art will recognize that the discussion herein relating to roll up doors is exemplary only and that other types of doors are suitable for use with the present invention. For example, swing doors or fixed shaft roll up doors are certainly contemplated as being within the scope of the invention. As shown in FIGS. 8 and 9 for a fixed shaft roll up door 32', locking mechanism is identical to that used in FIGS. 3–5. However, lock bar 44 interacts with a plate 45, interfering with movement of same shown in FIG. 8 while allowing free rotation of same in FIG. 9.

In addition, the above discussion refers to motors. However, those skilled in the art will recognize that other mechanism are suitable for use with the present invention, including, but not limited to, hydraulic systems.

Turning now to FIGS. 6*a*, 6*b*, 6*c* and 6*d*, upon arrival at the storage facility, the tenant enters an access code such as a personal identification number (PIN) into access control unit 16 at box 200 which is transmitted to computer 15. Computer 15 verifies that the access control unit 16 is in fact in the system at 202. If it is not, then a log of this event is recorded at 204. If a valid access control unit, computer 15 then verifies the validity of the PIN number at 206. If an invalid PIN, display 26 provides a message to the user to that effect at 208 and the event is entered in the transaction logs at 210.

If the PIN is valid, then, at box 212, computer 15 updates the tenants last visit records. Next, at box 214, computer evaluates whether the particular tenant is authorized entrance at the particular location. If not, a message is transmitted back to the display 26 indicating that status at 216 and the event logged at 218. This might occur if a tenant has a valid PIN for a multi-location system but their storage unit is not located at the location of the access control unit 16.

If the tenant is authorized for the particular location, computer 15 next checks, at 220, as to whether the tenant is authorized at this particular time. If not, a message is transmitted back to the display 26 indicating that status at 222 and the event logged at 224.

If the tenant is authorized for the particular time, computer 15 verifies and cross references that the PIN entered is associated with an existing storage unit 12 at 226. If not, a message is transmitted back to the display 26 indicating that status at 228 and the event logged at 230.

If the cross reference checks out, computer 15 proceeds to determine that storage unit 12 is equipped with a locking mechanism 30 at 232. If not, computer 15 moves to the on-site management phase of this system at 234. If the storage unit 12 is equipped with a locking mechanism 30, computer 15 checks to see if the tenant is attempting an interior entry, an interior exit, an exterior exit or and exterior entry at 236. An interior entry occurs when a tenant has already gained access to the interior of perimeter 13, as, for example, by accessing one storage unit and now wants to access a second storage unit. In some instances, the facility may be divided into a plurality of interior secured units and the user may be moving from one such interior secured unit to another. In interior exit is when the tenant is leaving one unit for that second unit. An exterior exit is when the tenant desires to leave the facility and an exterior entry is when a tenant is trying to enter perimeter 13 via security gate 14 or other access point.

If the tenant is attempting an interior entry or interior exit or exterior entry, computer 15 moves to the on-site management phase of this system at 234. If the tenant is attempting an exterior exit, computer 15 moves to the exit phase of the system, shown at FIG. 6*d*, at 238.

Turning to FIG. 6*d*, computer 15 first checks the lock database at 302 for the status of all of the tenant's doors 32. Computer 15 also queries door 32 itself at 304 for its status. If door 32 is closed at 306, computer 15 moves on at 308 to the on-site entry/exit process described in FIG. 6*b*.

If, instead, door 32 is open at 306, computer 15 checks to determine if the tenant has exceeded a pre-determined number of attempts at 310. If not, computer 15 displays a message to that effect on display 26 indicating that status at 312, enters the event in the transaction file at 314 and enters the attempt in a database at 316.

If the user has exceeded the number of attempts, computer 15 next checks to see if an override is in place at 318. If an override is not available, computer 15 displays a message to that effect on display 26 at 320, enters the event in the transaction file at 322 and notifies the manager of the facility at 324. If an override is available, computer 15 displays a message to that effect on display 26 at 326, enters the event in the transaction file at 328 and notifies the manager of the facility at 330. Next, computer 15 moves on at 308 to the on-site entry/exit process described in FIG. 6*b*.

Turning now to FIG. 6*b*, the on-site entry/exit process is described in more detail. Computer 15 first determines if this is an interior exit/entry or an exterior exit/entry at 240. If an interior exit/entry, computer 15 reviews its transaction logs to verify that the tenant is actually on-site at 242, i.e., that the tenant is logged in as entering storage facility 10. If not, a message is transmitted back to display 26 indicating that status at 244 and the event logged at 246. If the tenant is logged in, a message is transmitted back to display 26 indicating that status at 248, the transaction logged at 250 and the interior access point is opened at 252.

If an exterior entry/exit, i.e. the tenant either arriving at or leaving from security gate 14, computer 15 first checks if this is primary account at 262 and adds another if not at 264 and if so at 266. Computer 15 next checks the tenants account status at 268. If the tenant is locked out, by for example, non payment of rent, a message is transmitted back to display 26 indicating that status at 270 and the transaction logged at 272. If, on the other hand, the account is approved, then a message is transmitted back to display 26 indicating that status at 274, the transaction logged at 276 and the on site database is updated at 278.

Figure 6A:
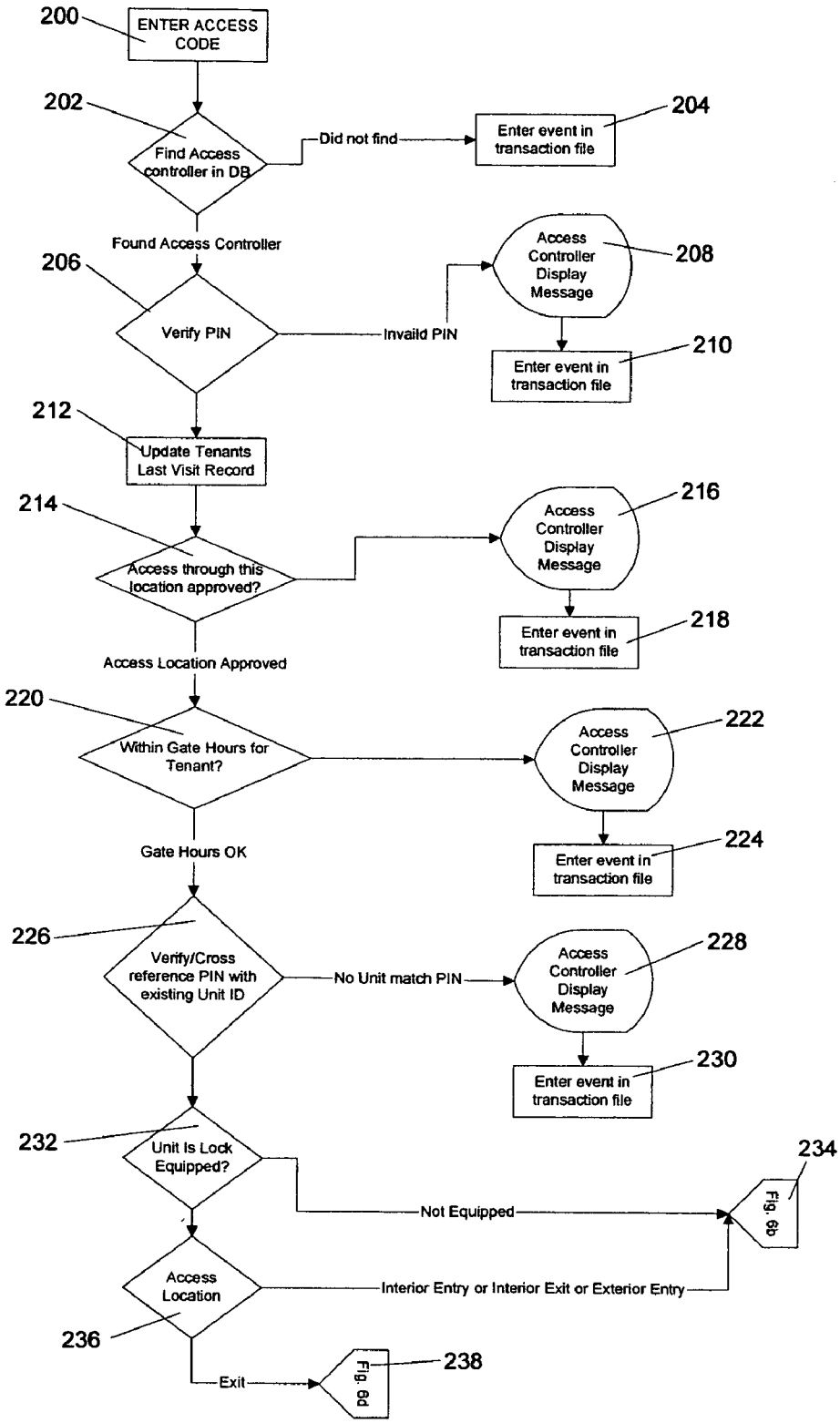
Figure 6C:
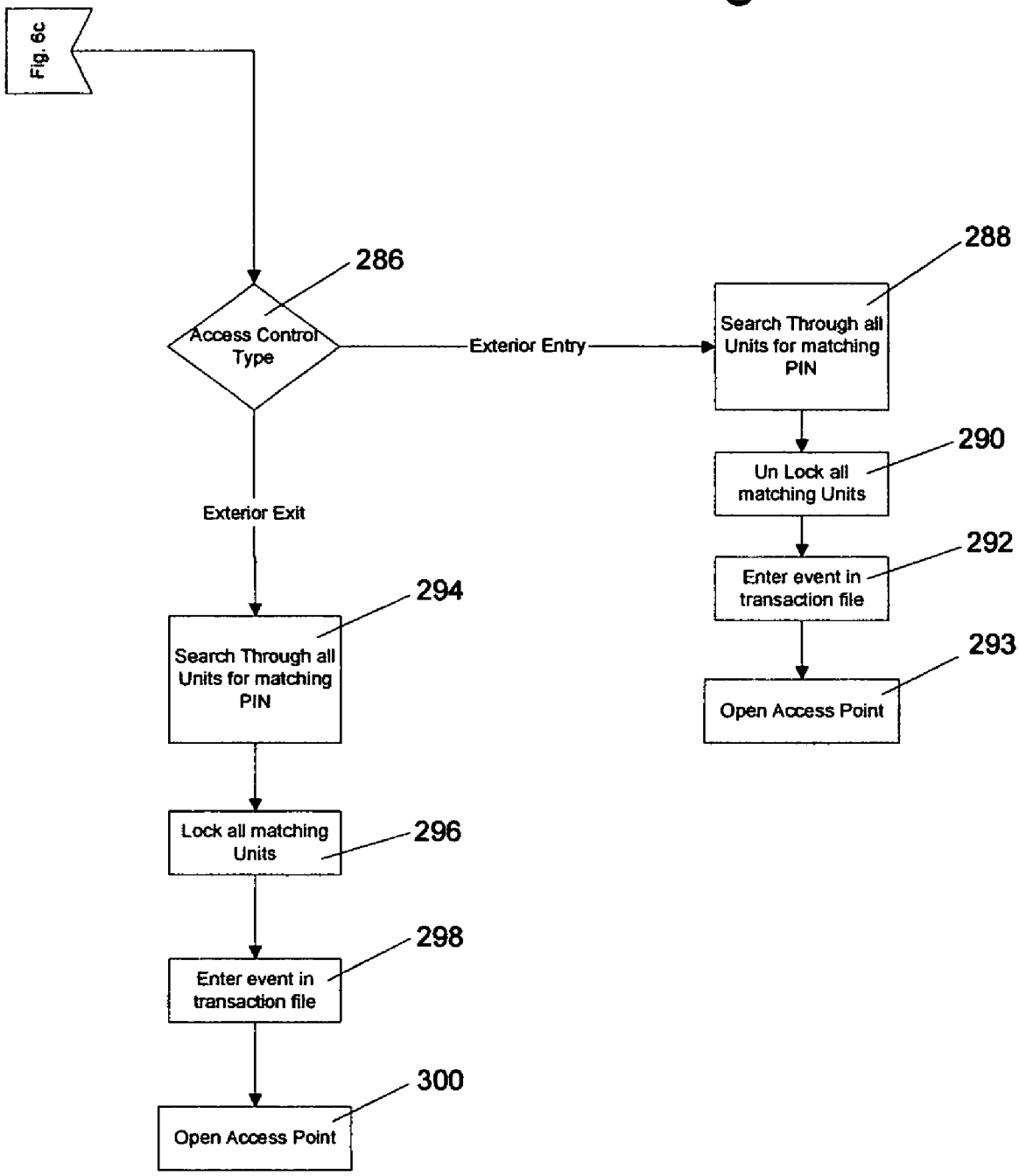

Computer 15 next checks to see if the tenant has locking mechanism 30 on their individual storage unit 12 at 280. If not, access point or security gate 14 is simply opened at 282 and the tenant allowed in or out. If the tenant's storage unit 12 does have locking mechanism 30, computer 15 moves to managing those locks at 284 and as shown in FIG. 6*c*. First, computer 15 determines what type of access is being sought at 286, namely, either exterior exit or exterior entry. If entry, computer 15 searches all storage unit 12 databases for matching PIN numbers at 288 and unlocks all such units 12 at 290. The transaction is logged at 292 and security gate 14 opened at 293. If exit, computer 15 searches all storage unit 12 databases for matching PIN numbers at 294 and locks all such units 12 at 296. The transaction is logged at 298 and security gate or access point 14 is opened at 300.

Figure 7A:
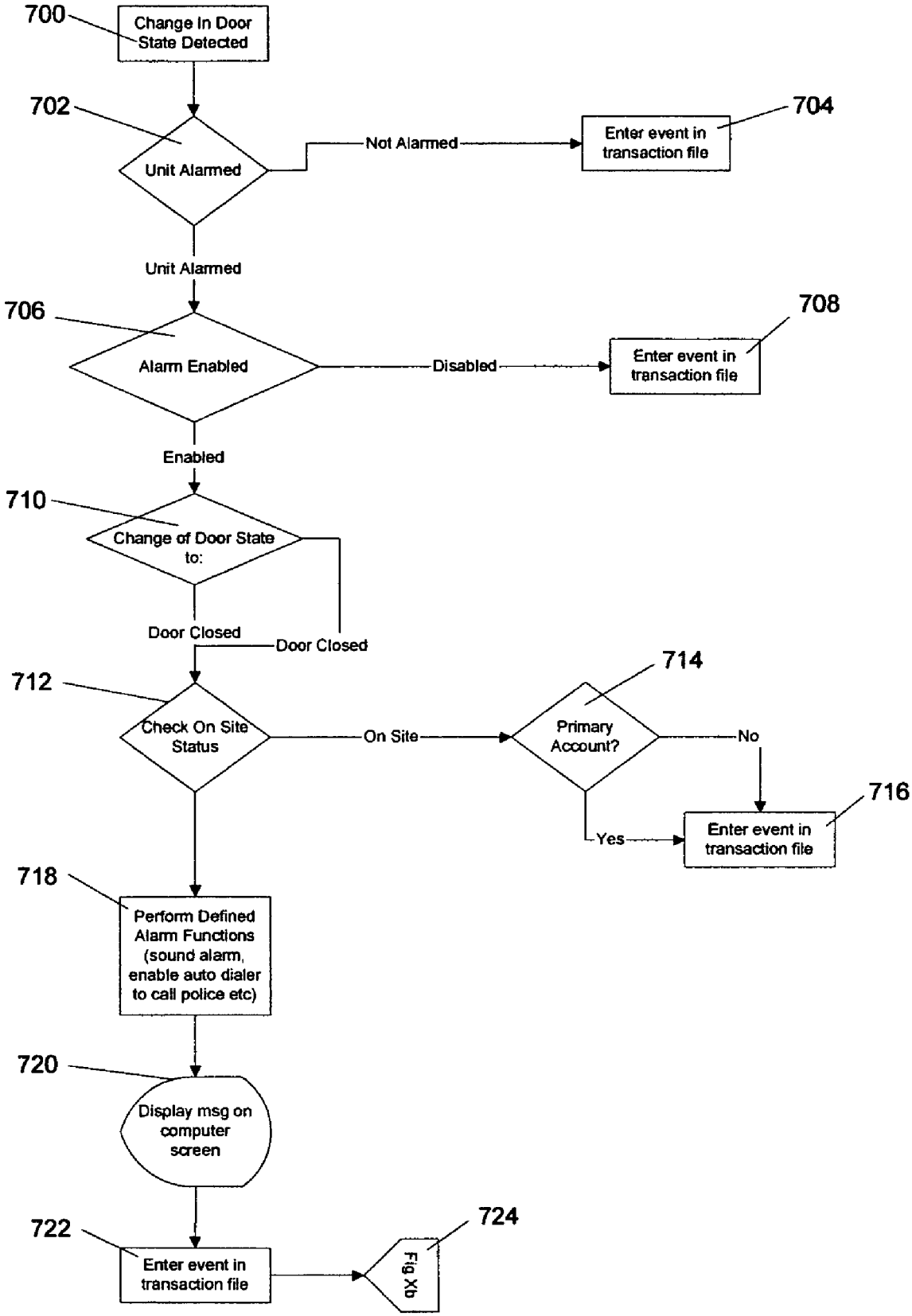
FIGS. 7*a* and 7*b* are, in combination, a flow chart showing the alarm system employed as part of the present invention in a storage facility.
Figure 7B:
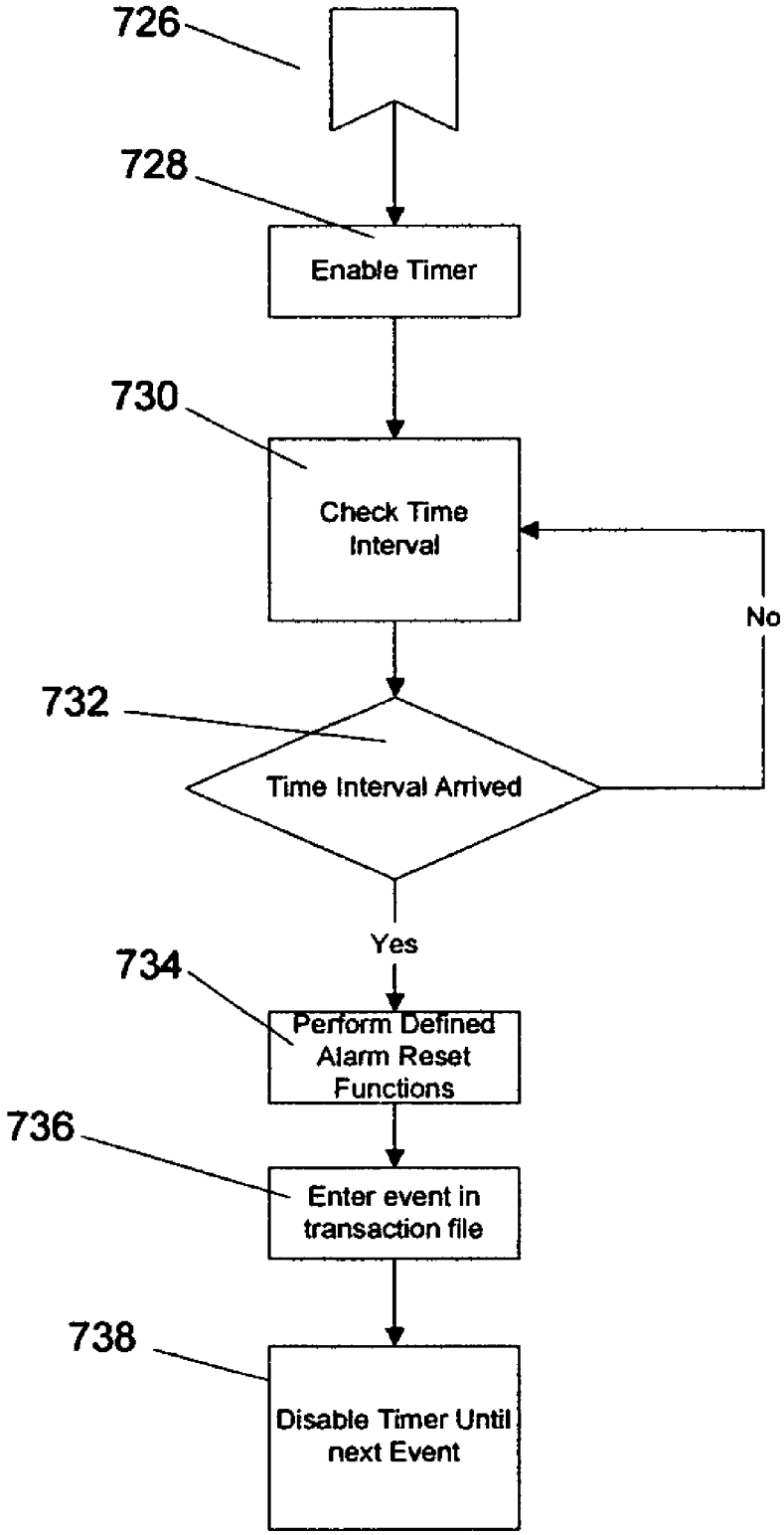

FIGS. 7*a* and 7*b* detail the flow relating to alarms 31. At 700, computer 15 detects a change in the status of a given door 32. If the unit is not alarmed at 702, then the event is simply logged in a transaction file at 704. If door 32 is alarmed, computer 15 next checks to see if alarm 31 is enabled at 706. If alarm 31 is not enabled, the event is logged in the transaction file at 708. At 710, computer 15 changes door 32 status as determined. Next, computer 15 checks at 712 if the tenant for door 32 is on-site. If so, computer 15 checks at 714 whether the on-site tenant is the primary account. In either event, computer 15 logs the event in the transaction file at 716.

If the tenant is not on-site, alarm 31 performs its designated functions, ranging from sounding an audible alarm, auto dialing police, flashing warning lights or any other function the facility elects to use at 718. Computer 15 displays a message to the effect that the alarm has been activated at 720 and logs the event in the transaction file at 722. The flow moves from FIG. 7*a* at 724 to FIG. 7*b* at 726.

Computer 15 enables a timer at 728 which continuously monitors the time at 730. Computer 15 checks to see if a selected time interval has passed at 732. If not, computer 15 recycles back to monitoring the time at 730. If the time interval has passed at 732, computer 15 resets alarm 31 at 734 and logs the event in the transaction file at 736. The timer is then disabled at 738 to await the next door status change Although only certain embodiments have been illustrated and described, it will be apparent to those skilled in the art that various changes and modifications may be made therein without departing from the spirit of the invention or from the scope of the appended claims.

That which is claimed is:

1. An improved storage system comprising:

a plurality of individual storage units, each of the plurality of individual storage units having a door, alarm and a locking mechanism, each of the doors having a door sensor which senses whether said each door is open or closed, said door sensor being in electrical communication with a computing device, each of the locking mechanisms having a position sensor which senses whether each locking mechanism is in a locked position or an unlocked position, said position sensor being in electrical communication with the computing device, each of the locking mechanisms having a motor for moving the locking mechanism between the locked position and the unlocked position, the motor being actuated by the computing device, one or more access control units located proximate to the plurality of individual storage units, said access control unit being in electrical communication with the computing device, the computing device reviewing information from the access control unit and opening and closing the locking mechanisms, turning on and off the alarms, and determining the open and closed status of each door in response to the information from the access control unit.

2. The improved storage system of claim 1 wherein the access control unit comprises a housing having a plurality of keys mounted on the front thereof.

3. The improved storage system of claim 2 having 12 keys comprising the numerals 0–9 and an asterisk and a pound sign thereon.

4. The improved storage system of claim 2 further comprising a speaker associated with the access control unit for communication with an attendant as needed.

5. The improved storage system of claim 2 further comprising a display associated with the access control unit to communicate with the computing device.

6. The improved storage system of claim 1 wherein the door is a rollup door having an axle for opening and closing said rollup door.

7. The improved storage system of claim 6 wherein the locking mechanism includes a U-shaped locking member having a base surrounding the axle and two legs extending away from the axle and a pin which extends through the locking member and the axle to secure said locking member and axle together, the locking mechanism further having a lock bar which slides between the locked position located between the legs and the unlocked position situated outside of the legs.

8. The improved storage system of claim 7 wherein the movement of the lock bar is controlled by the motor.

9. The improved storage system of claim 8 wherein the position sensor comprises two limit switches and two shoulders formed on the lock bar, the limit switches having arms extending therefrom which engage the shoulders, one of said arms engaging one of the shoulders when the lock bar is in the unlocked position and the other of said arms engaging the other of the shoulders the lock bar is in the locked position.

10. The improved storage system of claim 1 wherein the information entered into the access control unit by an entering tenant is a personal identification number sent to the computing device, the computing device determining whether the personal identification number matches a valid number associated with a particular storage unit in a computer database associated with the computing device and whether the entering tenant associated with the valid number is allowed access to the storage unit.

11. The improved storage system of claim 10 wherein the computing device determines the status of the locking mechanism via the position sensor, whereby if the locking mechanism is in the unlocked position, the computing device further reviews a transaction log contained in the computer database whereby the computing device opens the security gate and disables alarms if the entering tenant is on-site but notifies supervisory personnel if said tenant is not on site;

whereby if the locking mechanism is in the locked position, the computing device further checks the status of the door via the door sensor, whereby if the door is closed, then the computing devices opens the security gate, disables the alarms and unlocks the locking mechanism, and whereby if the door is open, the computing device reviews the transaction logs to determine if the entering tenant is on site and, if so, opens the security gate, disables the alarms and unlocks the locking mechanism but notifies supervisory personnel if said tenant is not on site.

12. The improved storage system of claim 1 wherein the information entered into the access control unit by an exiting tenant is a personal identification number sent to the computing device, the computer determining the open or closed status of the door to the storage unit of the exiting tenant whereby if the door is open, the computing device notifies the exiting tenant of that status and directs said exiting tenant to close said door, the computing device opening the security gate, enabling the alarms and moves the locking mechanism to the locked position.

13. The improved storage system of claim 1 further comprising a secured perimeter enclosing the plurality of storage units, the secured perimeter having one or more security gates for entry and exit through said secured perimeter.

14. The improved storage system of claim 13 the one or more access control units being located proximate to the one or more security gates, the computing device reviewing information from the one or more access control units and opening and closing the one or more security gates in response to said information.

15. The improved storage system of claim 1 wherein the one or more alarms are activated in response to changes in the open and closed status of said doors.

* * * * *